US011465807B2

(12) United States Patent
Morisey

(10) Patent No.: US 11,465,807 B2
(45) Date of Patent: Oct. 11, 2022

(54) PORTABLE CONTAINER FOR BAR SUPPLIES

(71) Applicant: Philip Morisey, Walnut Creek, CA (US)

(72) Inventor: Philip Morisey, Walnut Creek, CA (US)

( * ) Notice: Subject to any disclaimer, the term of this patent is extended or adjusted under 35 U.S.C. 154(b) by 0 days.

(21) Appl. No.: 16/927,854

(22) Filed: Jul. 13, 2020

(65) Prior Publication Data

US 2021/0009312 A1 Jan. 14, 2021

Related U.S. Application Data

(60) Provisional application No. 62/872,953, filed on Jul. 11, 2019.

(51) Int. Cl.

| | |
|---|---|
| ***B65D 25/04*** | (2006.01) |
| ***B65D 25/28*** | (2006.01) |
| ***B65D 43/22*** | (2006.01) |
| ***B65D 51/24*** | (2006.01) |
| ***B65D 43/16*** | (2006.01) |

(52) U.S. Cl.

CPC ..... *B65D 25/04* (2013.01); *B65D 25/2841* (2013.01); *B65D 43/163* (2013.01); *B65D 43/22* (2013.01); *B65D 51/245* (2013.01); *B65D 2543/00574* (2013.01)

(58) Field of Classification Search

CPC .. B65D 51/245; B65D 25/2841; B65D 25/04; B65D 43/163; B65D 2543/00574; A45C 2013/026; A45C 13/02; A45C 13/1084; A45C 11/20

USPC ..... 220/528, 506

See application file for complete search history.

(56) References Cited

U.S. PATENT DOCUMENTS

| | | | | | |
|---|---|---|---|---|---|
| 4,768,651 | A * | 9/1988 | Lanius | A01K 97/06 | 206/315.1 |
| 5,011,020 | A * | 4/1991 | Stevens | A45C 13/02 | 206/438 |
| 5,257,721 | A * | 11/1993 | Smith | B44D 3/04 | 206/1.7 |
| 5,882,097 | A * | 3/1999 | Kohagen | B25H 3/023 | 312/235.1 |
| 5,915,554 | A * | 6/1999 | Hung | B65D 51/002 | 206/372 |
| 6,116,426 | A * | 9/2000 | Slonim | A61F 17/00 | 206/499 |
| 8,210,387 | B2 * | 7/2012 | Twig | B25H 3/023 | 220/521 |
| 9,637,294 | B2 * | 5/2017 | Kinskey | A45C 13/02 | |
| RE47,022 | E * | 9/2018 | Sosnovsky | B25H 3/02 | |
| 10,328,745 | B2 * | 6/2019 | John | A45C 3/004 | |
| 10,994,892 | B2 * | 5/2021 | Bell | B65D 1/22 | |
| 2007/0194024 | A1 * | 8/2007 | Liaw | B25H 3/06 | 220/23.6 |
| 2007/0272572 | A1 * | 11/2007 | Chen | B25H 3/021 | 206/373 |

(Continued)

*Primary Examiner* — Ernesto A Grano

(74) *Attorney, Agent, or Firm* — West & Associates, A PC; Stuart J. West; Charlotte Rodeen-Dickert

(57) ABSTRACT

A portable container to transport bar garnishes and equipment. A first section of the container folds out to become a preparation area while a plurality of removable trays are seated in a second section of a container. Trays are interchangeable and removable for filling emptying and cleaning.

6 Claims, 10 Drawing Sheets

(56) References Cited

U.S. PATENT DOCUMENTS

| | | | | |
|---|---|---|---|---|
| 2011/0284555 | A1* | 11/2011 | Barringer | A45C 11/20<br>220/592.01 |
| 2015/0183536 | A1* | 7/2015 | Miros | B65D 45/16<br>53/484 |

* cited by examiner

PORTABLE CONTAINER FOR BAR SUPPLIES

CLAIM OF PRIORITY

Cross-Reference to Related Application(s)

This application claims the benefit of priority of U.S. Provisional Application 62/872,953 filed Jul. 11, 2019, all of which is incorporated by reference herein.

BACKGROUND

Technical Field

The present device relates to the field food preparation containers and more specifically to portable barware.

Background

Preparing cocktails is a popular culinary art among professionals and amateurs alike. Having a well-stocked and organized bar facilitates this activity. While at home, this can remain standing and ready for use. However, when dining remotely, such as picnicking, camping, or tailgating, it can be a challenge to bring along the desired garnished and accessories in an organized fashion. What is needed is a portable bar device that can conveniently fit in the bed of a truck or the trunk of a car, all while keeping bar accoutrements organized.

BRIEF DESCRIPTION OF THE DRAWINGS

Further details of the present device are explained with the help of the attached drawings in which.

DETAILED DESCRIPTION

Figure 1A:
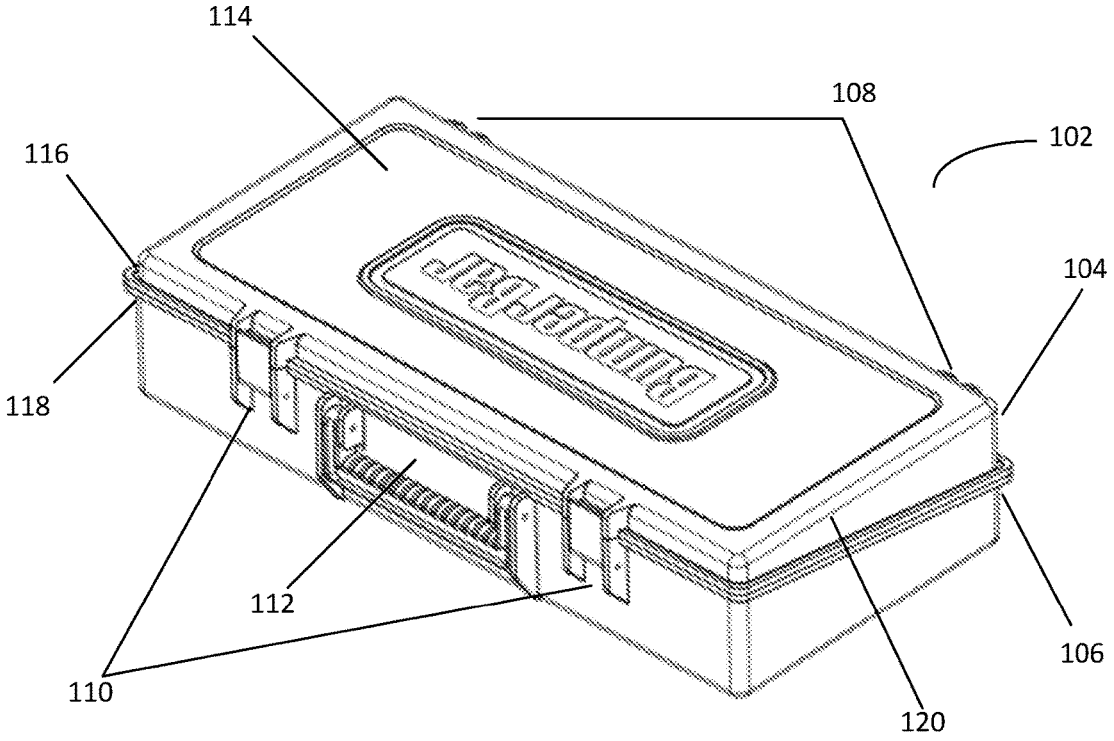
FIG. 1*a* depicts a perspective view of an embodiment of the present device.
Figure 1B:
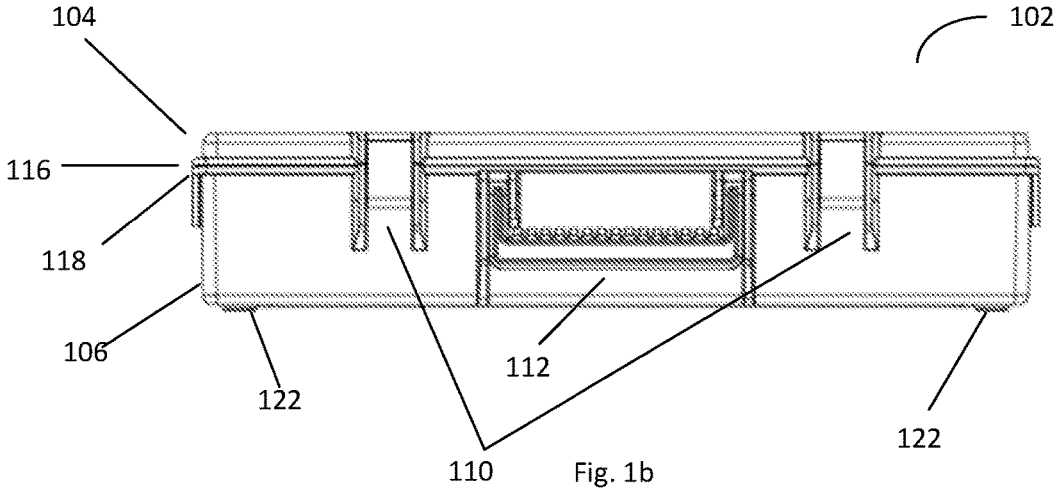
FIG. 1*b* depicts a first side view of the embodiment shown in FIG. 1*a*.
Figure 1C:
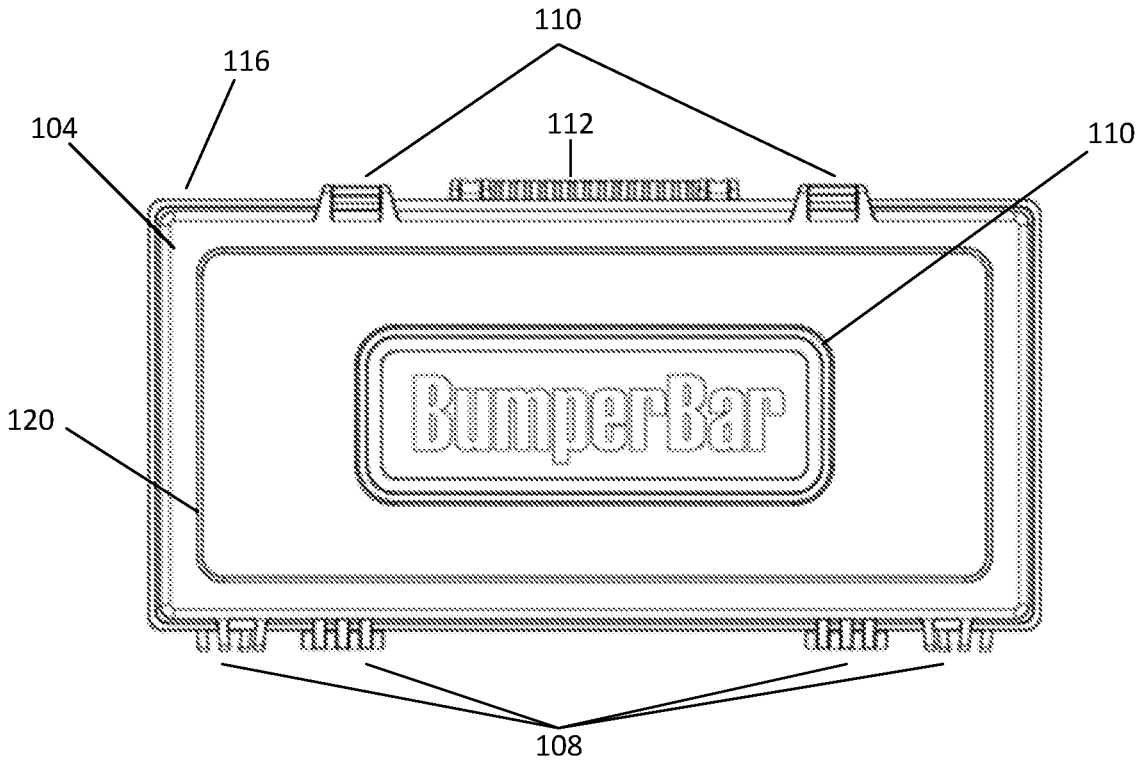
FIG. 1*c* depicts a top view of the embodiment shown in FIG. 1*a*.
Figure 1D:
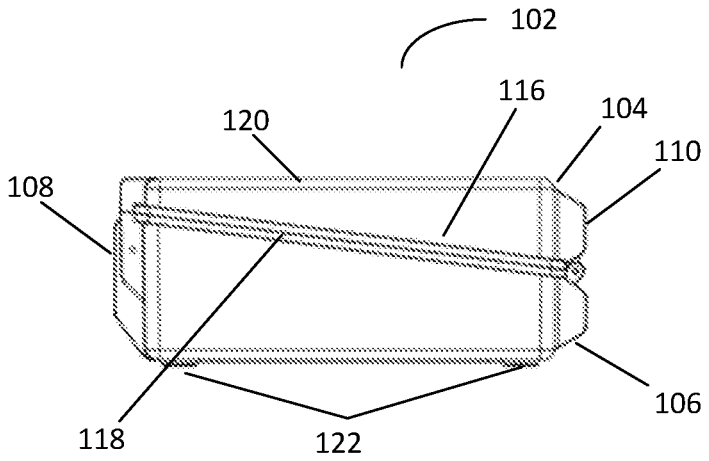
FIG. 1*d* depicts a end view of the embodiment shown in FIG. 1*a*.

FIGS. 1(*a*)-1(*d*) depict various views of the present device. In some embodiments, a container 102 can comprise a first section 104 and a second section 106. As shown in FIG. 1(*a*), in some embodiments container 102 can have a substantially rectangular geometry, but in other embodiments can be rounded or any other known and/or configuration. A first section 104 and a second section 106 can be connected along a first edge with hinges 108 or any other known and/or convenient device that allows a first section 104 and a second section 106 move so as to open and close a container 102. In some embodiments, at least one latch 110 can be attached to second edges substantially parallel to the first edges, opposite hinges 108. As shown in FIGS. 1(*a*)-1(*c*), a handle 112 can be attached to a second section 106 between a pair of latched 110. However, in other embodiments a handle 112 can be attached to a first section 104 or to any other known and/or convenient location on a container 102. In some embodiments a planar surface of a first section 104 can have a region 114 for a logo, texturing, or any other known and/or convenient decoration. As shown in FIGS. 1(*a*)-1(*d*), a first section can have a lip 116, and a second section 106 can have a lip 118. In some embodiments, a first section 104 can have a raised perimeter border 120, but in other embodiments can have any other known and/or convenient configuration. In some embodiments, a container 102 and its components, hinges 108, latches 110, and a handle 112 can be comprised of wood, metal, polymer or any other known and/or convenient materials in any known and/or convenient combination.

As shown in FIG. 1(*b*)-1(*d*), a plurality of protrusions 122 can extend from the exterior planar side of a second section 106. In embodiments having a substantially rectangular container 102, protrusions 122 can be located substantially at the corners of the exterior planar surface of a second section 108, but in other embodiments can be located in any known and/or convenient position. In some embodiments, protrusions 122 can be spaced to selectively engage the trough portions of a truck tailgate. In such embodiments, protrusions 122 can hold a container secure on a truck tailgate.

As shown in FIG. 1(*d*), in some embodiments a first section 104 and a second section 106 can connect along lip 116 and lip 118. In some embodiments, a first section 104 and a second section 106 can meet on a line substantially parallel to the planar surfaces of a first section 104 and a second section 106, but as shown in FIG. 1(*d*) can meet along a line not parallel to either planar surface of first section 104 and second section 106.

Figure 2:
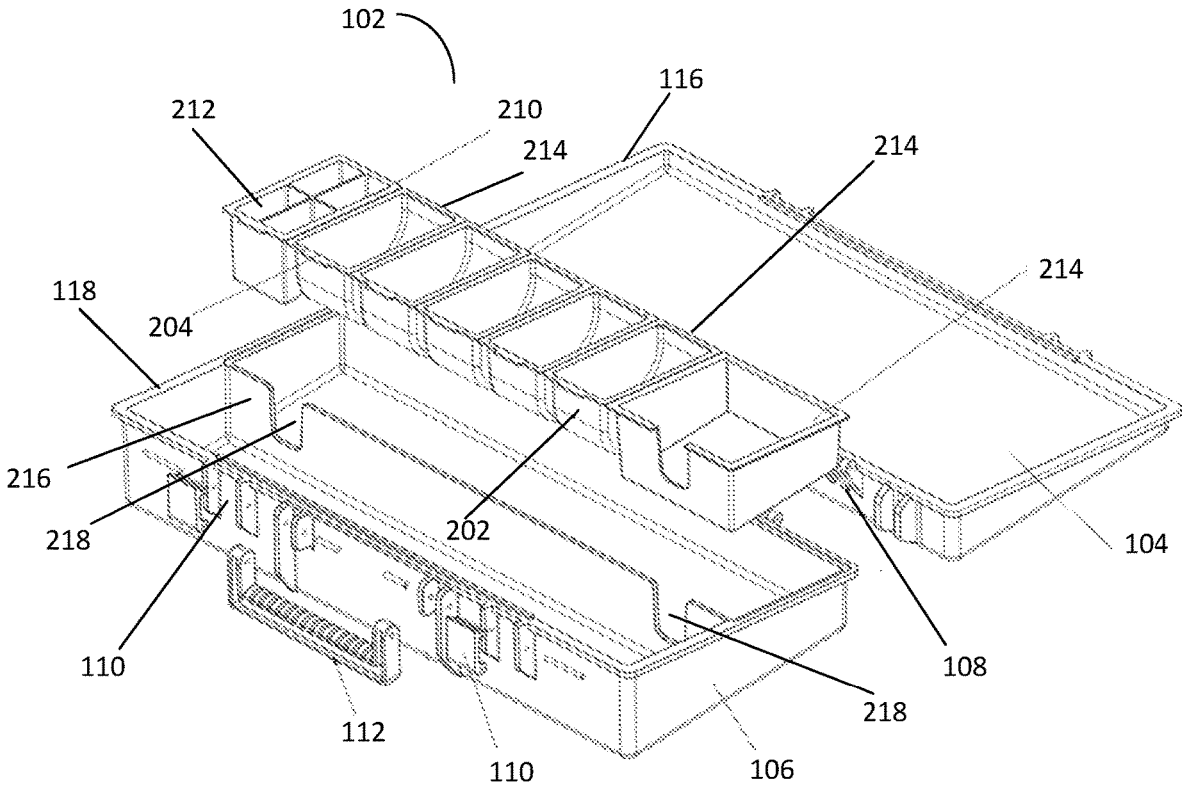
FIG. 2 depicts an expanded perspective view of the embodiment shown in FIG. 1*a*.
Figure 3A:
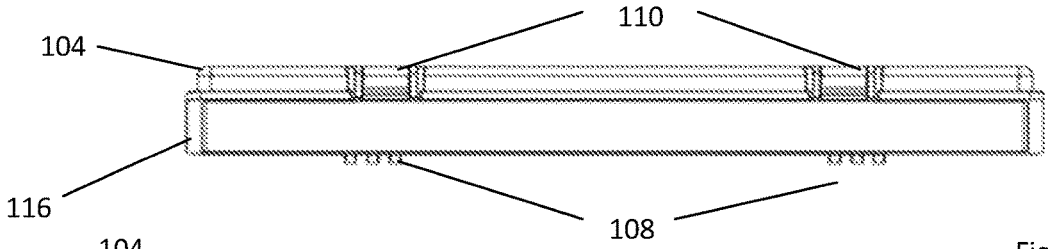
FIG. 3*a* depicts a first side view of a first container section in an embodiment of the present device.
Figure 3B:
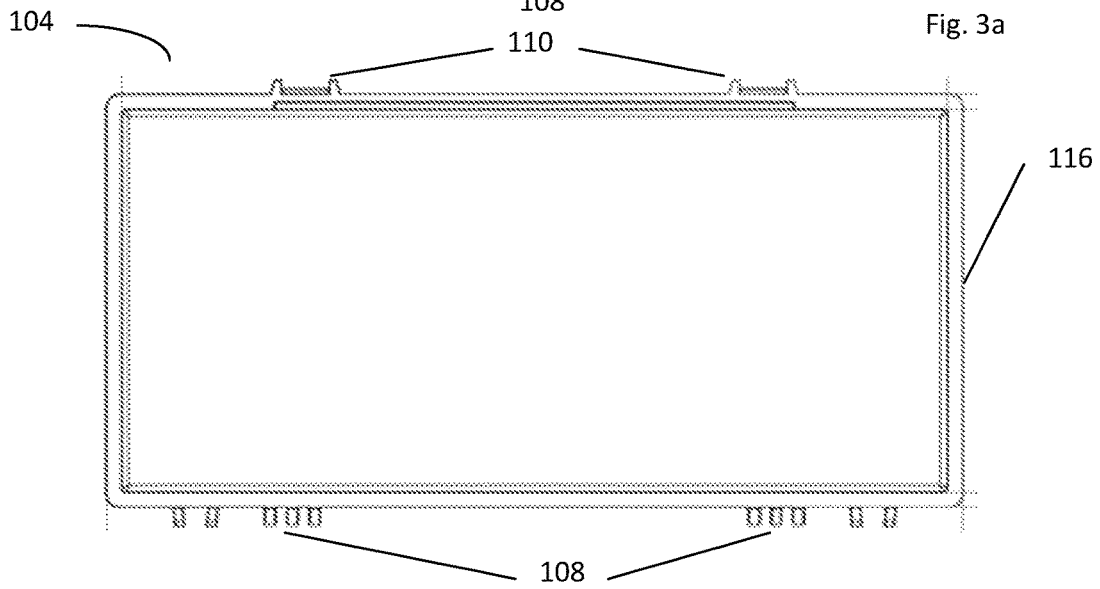
FIG. 3*b* depicts an interior planar view of a first container section in an embodiment of the present device.
Figure 3C:
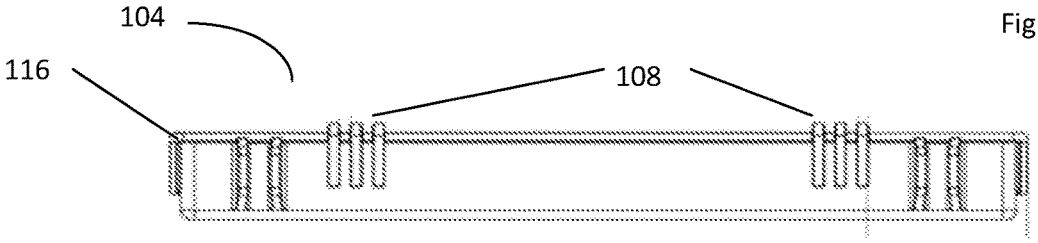
FIG. 3*c* depicts a second side view of a first container section in an embodiment of the present device.
Figure 3D:
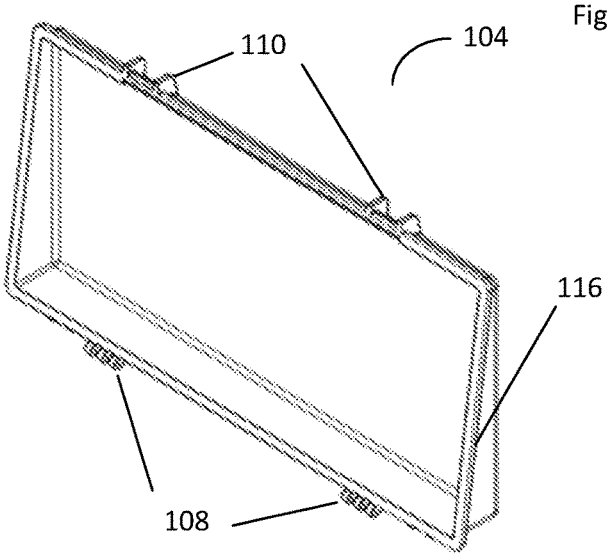
FIG. 3*d* depicts a perspective view of a first container section in an embodiment of the present device.
Figure 3E:
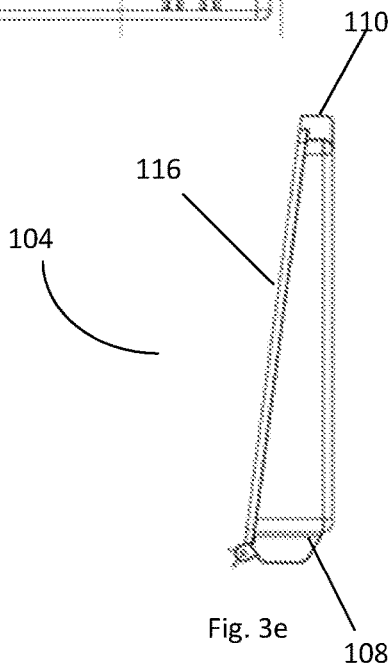
FIG. 3*e* depicts an end view of a first container section in an embodiment of the present device.
Figure 4A:
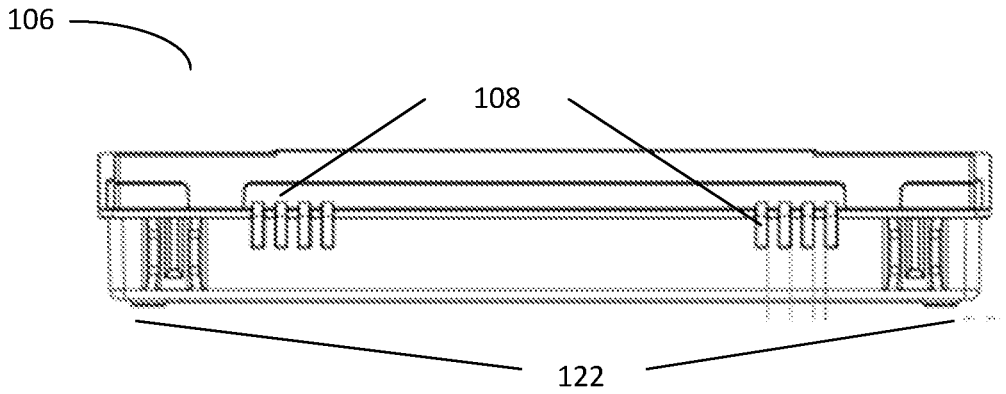
FIG. 4*a* depicts a first side view of a second container section in an embodiment of the present device.
Figure 4B:
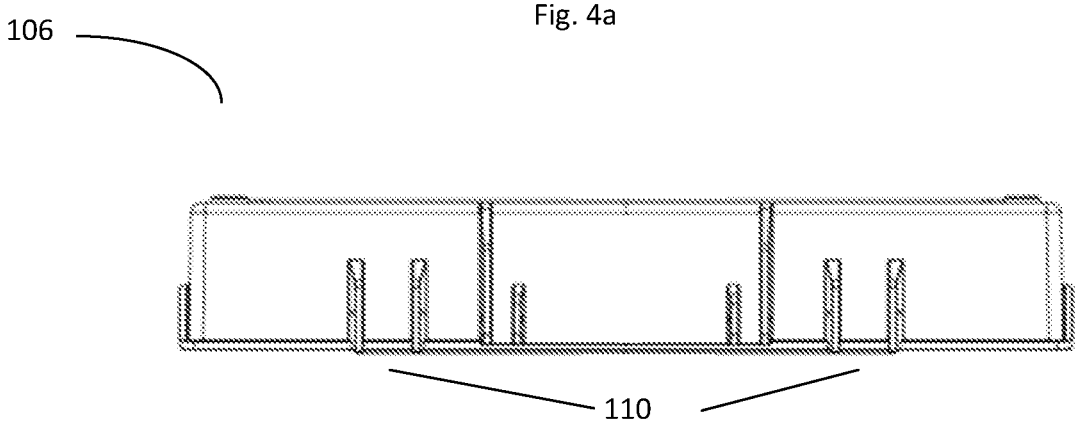
FIG. 4*b* depicts a second side view of a second container section in an embodiment of the present device.
Figure 4C:
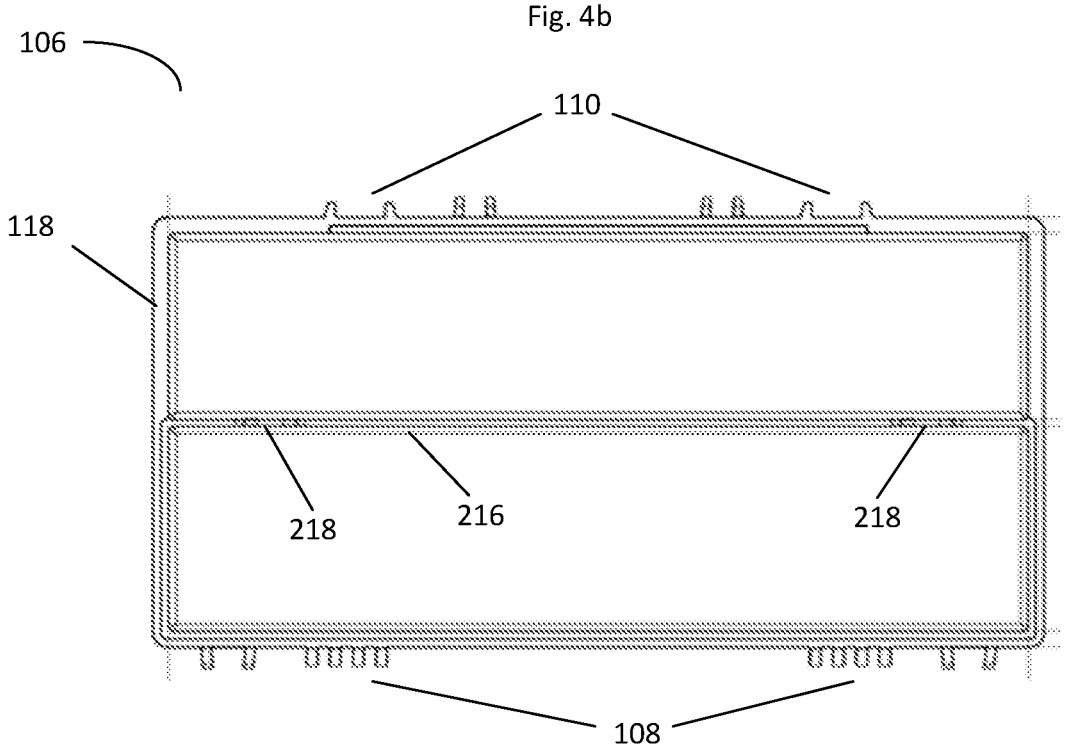
FIG. 4*c* depicts a planar interior view of a second container section in an embodiment of the present device.
Figure 4D:
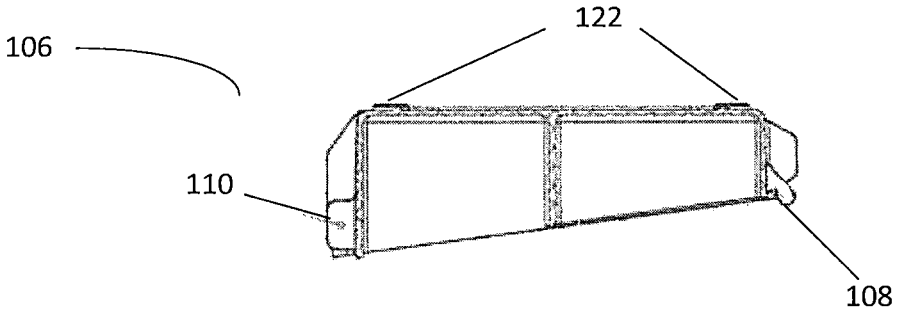
FIG. 4*d* depicts a cross-sectional view of a second container section in an embodiment of the present device.
Figure 4E:
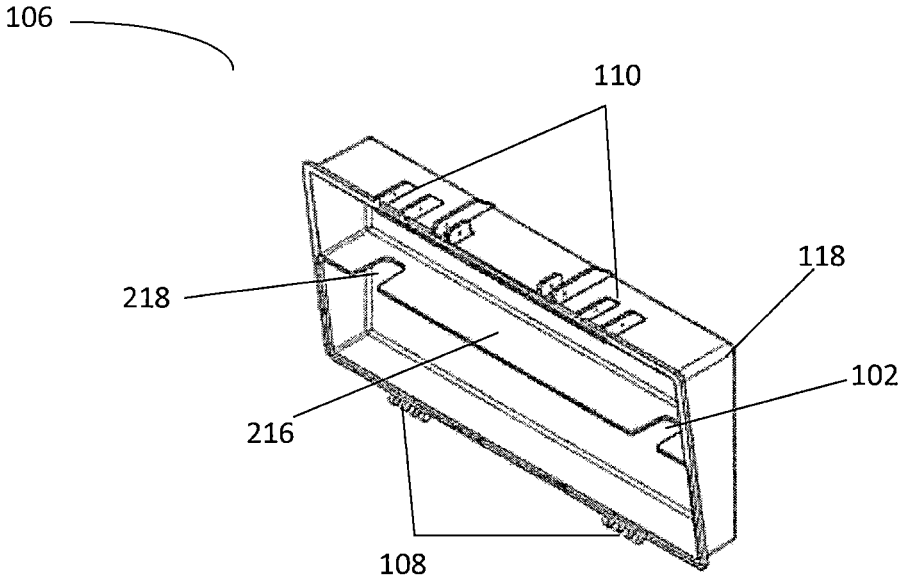
FIG. 4*e* depicts a perspective interior view of a second container section in an embodiment of the present device.
Figure 4F:
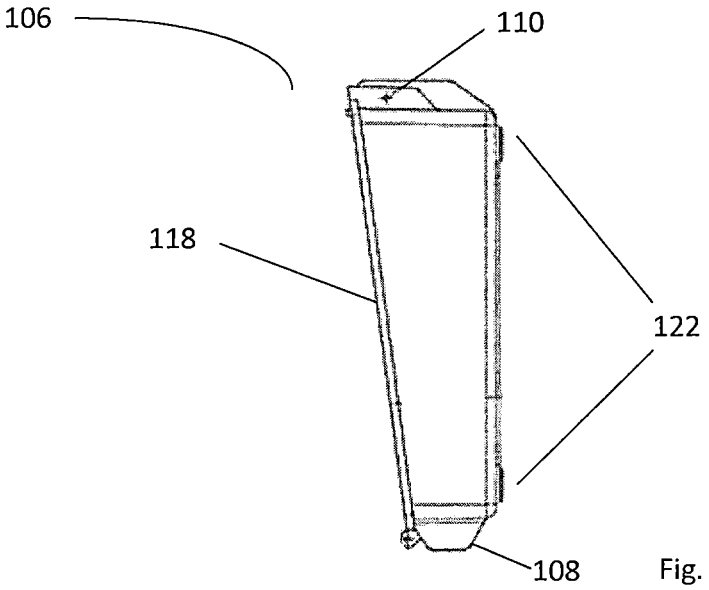
FIG. 4*f* depicts an end view of a second container section in an embodiment of the present device.

FIG. 2 depicts an expanded perspective of a container 102 in an open configuration. A plurality of trays 202 206 210 can selectively engage with a second section 164. In some embodiments trays 202 206 210 can have open tops with a lip 214 along their top perimeters and a tab 204 extending from a lip 214. In some embodiments, trays 202 206 210 can have a substantially rectangular geometry, but in other embodiments can have any other known and convenient geometry. In some embodiments trays 202 can be of substantially uniform size and dimensions. Tray 208 can have a wider dimension and a substantially square geometry and a cutout 208 in a front side or any other known and/or convenient configuration. Tray 210 can be subdivided into a plurality of sections 212. As shown in FIG. 2, a tray 210 can be divided into four substantially equal sections 212, but in other embodiments can be divided into any other and/or convenient number and/or convenient configuration of sections 212. In some embodiments, trays 202 206 210 can be comprised of a food-grade polymer, but in other embodiments can be comprised of any metal or any other known and/or convenient material.

As shown in FIG. 2, a second section 106 can further comprise a divider 216 that can have at least one notch 208. In some embodiments, a divider 216 can be positioned substantially along or substantially parallel to the longitudinal axis of a second section 106. In some embodiments, a divider 216 can be positioned to hold trays 202 206 210 against a longitudinal edge of a second section 106, but in other embodiments can be in any known and/or convenient position. In some embodiments, a divider 216 can be removably attached to a second section 106, but in other embodiments can be fixed and/or integrated with a second section 106. In some embodiments trays 202 206 210 can be interchangeable and removable for filling, emptying, and/or cleaning.

FIGS. 3(*a*)-3(*e*) depict various detail views of a first section 104. In some embodiments, a first section 104 can be considered a "top" section. In some embodiments, as shown in FIG. 3(*e*) a first section 104 can have a substantially trapezoidal cross-section where the longitudinal, substantially parallel sides of a first section 104 can be of differing heights. However, in other embodiments the longitudinal, substantially parallel sides of a first section 104 can be of substantially the same height, resulting in a substantially rectangular cross-sectional geometry.

FIGS. 4(*a*)-4(*f*) depict various detail views of a second section 106. In some embodiments, a second section 104 can be considered a "bottom" section. In some embodiments, as shown in FIG. 4(*f*) a first section 104 can have a substantially trapezoidal cross-section where the longitudinal, substantially parallel sides of a second section 106 can be of differing heights. However, in other embodiments the longitudinal, substantially parallel sides of a second section 106 can be of substantially the same height, resulting in a substantially rectangular cross-sectional geometry.

In embodiments where substantially parallel sides of a first section 104 are of differing heights, the taller height can be substantially the same as the height of a shorter substantially parallel side of a second section 106. In such embodiments, as shown in FIG. 2, this provides a smooth slanted transition from the higher portion of a second section 106 and allows easier access to a preparation area on the interior surface of a top section 104.

Figure 5A:
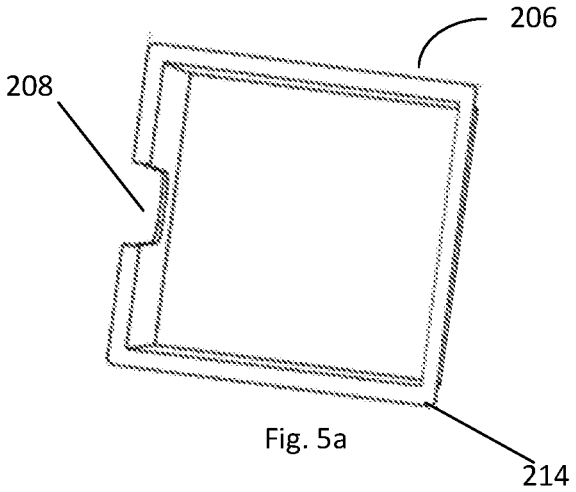
FIG. 5*a* depicts a top view of a first tray component in an embodiment of the present device.
Figure 5B:
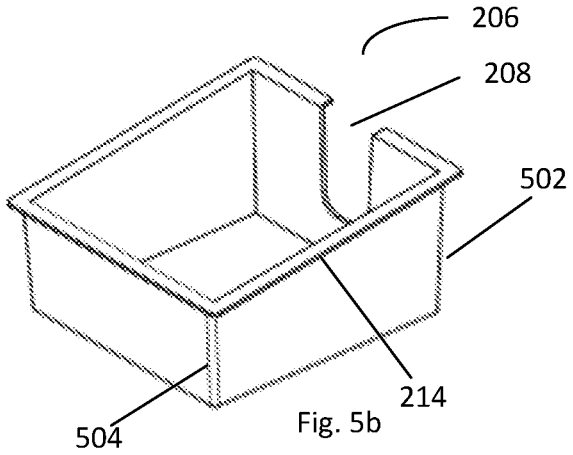
FIG. 5*b* depicts a perspective view of a first tray component in an embodiment of the present device.
Figure 5C:
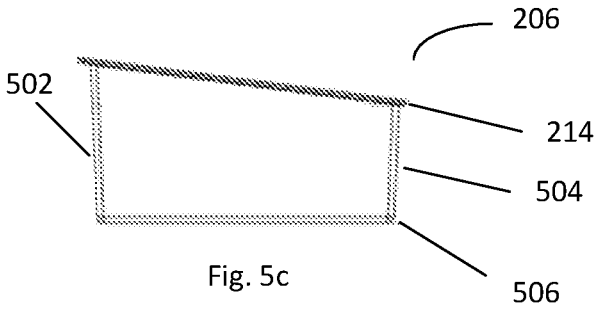
FIG. 5*c* depicts a side view of a first tray component in an embodiment of the present device.

FIGS. 5(*a*)-5(*c*) depict various detail views of a tray embodiment 206. In some embodiments, a tray 206 can have a front side 502 and a rear side 504 that can be substantially orthogonal to a base 506. In some embodiments, a front side 502 can have a taller height than a rear side 504 to create a substantially trapezoidal lateral cross-section. However, in other embodiments, a front side 502 and a rear side 506 can be of substantially equal heights to produce a substantially rectangular lateral cross-section, or any other known and/or convenient geometry. In some embodiments a tray 206 can have a substantially square base 506 and dimensions to hold a plurality of cocktail napkins, but in other embodiments can have any other known and/or convenient dimensions.

Figure 6A:
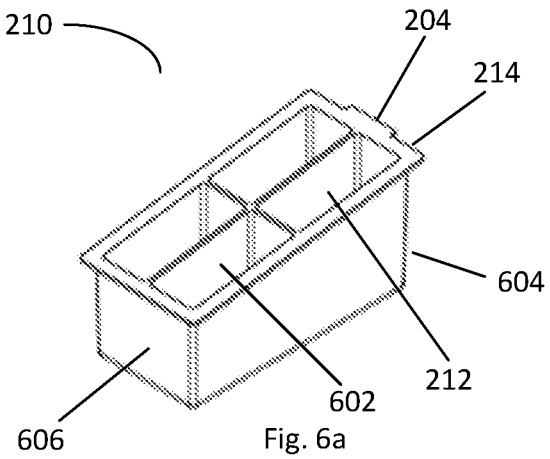
FIG. 6*a* depicts a perspective view of a second tray component in an embodiment of the present device.
Figure 6B:
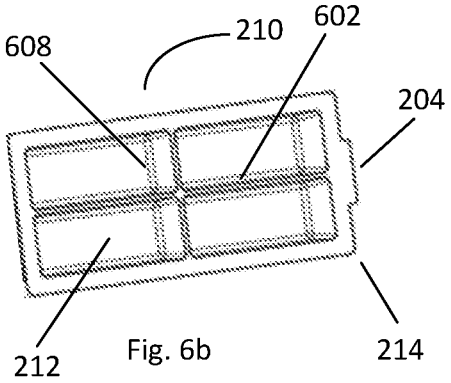
FIG. 6*b* depicts a top view of a second tray component in an embodiment of the present device.
Figure 6C:
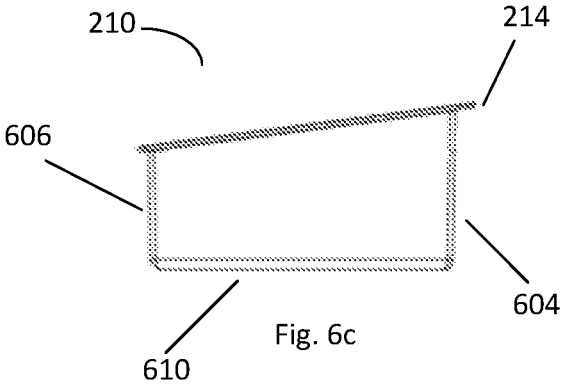
FIG. 6*c* depicts a side view of a second tray component in an embodiment of the present device.

FIGS. 6(*a*)-6(*c*) depict various detail views of a tray embodiment 210. In some embodiments, a tray 210 can have at least one divider 602 that can divide a tray 210 into a plurality of sections 212. As shown FIGS. 6(*a*) and 6(*c*), a tray 210 can have a front side 604 and a rear side 606 that can be substantially orthogonal to a base 610. In some embodiments, a front side 604 can have a taller height than a rear side 606 to create a substantially trapezoidal lateral cross-section. However, in other embodiments, a front side 604 and a rear side 606 can be of substantially equal heights to produce a substantially rectangular lateral cross-section, or any other known and/or convenient geometry. In some embodiments a tray 210 can have a substantially rectangular base 610 with rounded edges 608, but in other embodiments can have any other known and/or convenient dimensions. In some embodiments each section 212 can have rounded front and rear bottom edges 608.

Figure 7A:
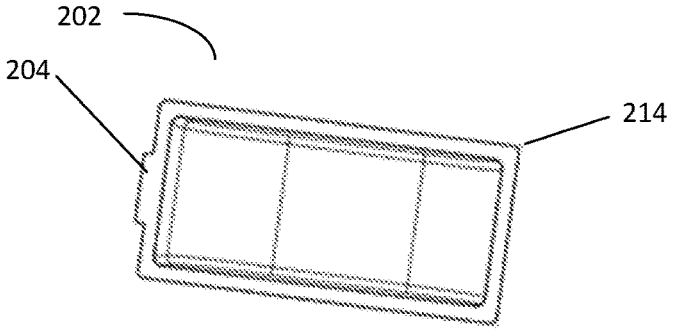
FIG. 7*a* depicts a top view of a third tray component in an embodiment of the present device.
Figure 7C:
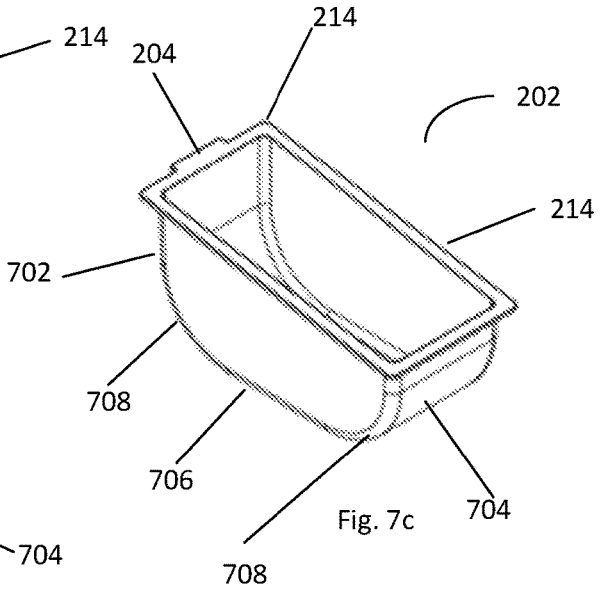
FIG. 7*c* depicts a perspective view of a third tray component in an embodiment of the present device.
Figure 7B:
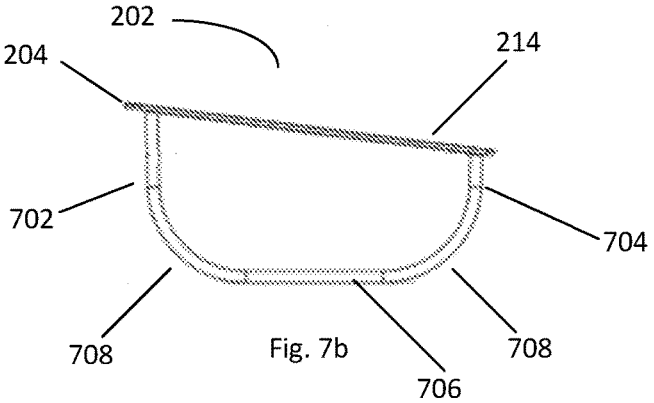
FIG. 7*b* depicts a side view of a third tray component in an embodiment of the present device.
Figure 8A:
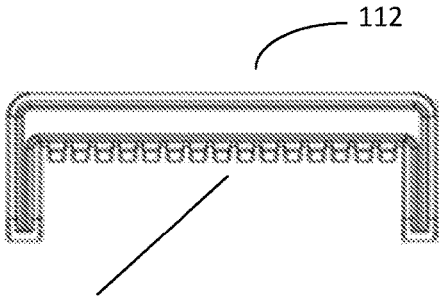
FIG. 8*a* depicts a side view of an embodiment of a handle in the present device.
Figure 8B:
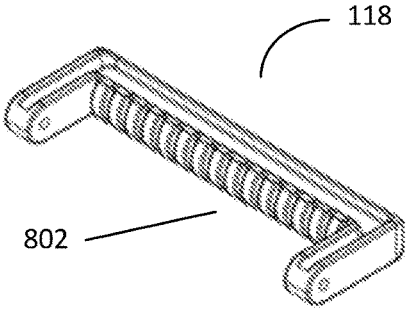
FIG. 8*b* depicts a perspective view of an embodiment of a handle in the present device.
Figure 8C:
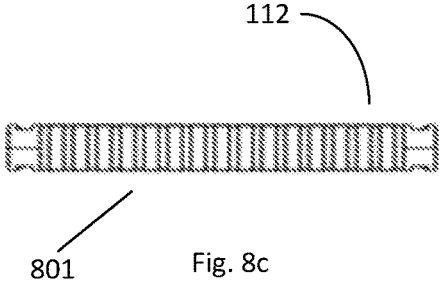
FIG. 8*c* depicts a top view of an embodiment of a handle in the present device.
Figure 8D:
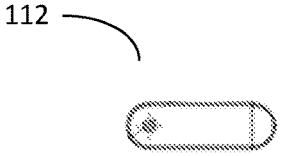
FIG. 8*d* depicts an end view of an embodiment of a handle in the present device.
Figure 9A:
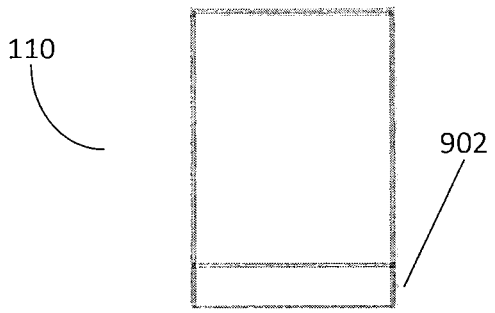
FIG. 9*a* depicts a top view of an embodiment of a latch in the present device.
Figure 9B:
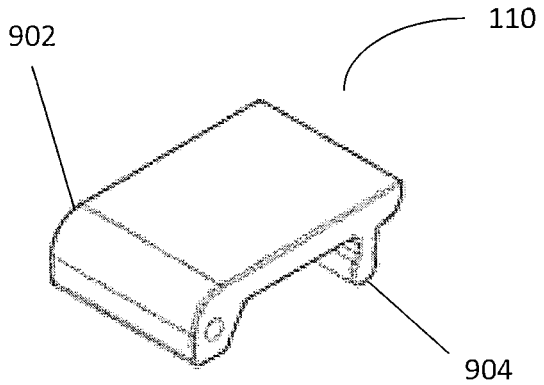
FIG. 9*b* depicts a perspective view of an embodiment of a latch in the present device.
Figure 9C:
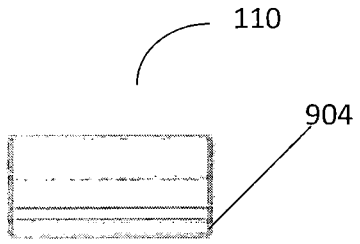
FIG. 9*c* depicts a side view of an embodiment of a latch in the present device.
Figure 9D:
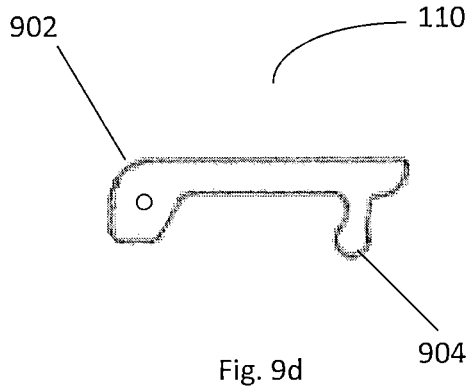
FIG. 9*d* depicts a cross-sectional view of an embodiment of a latch in the present device.

FIGS. 7(*a*)-7(*c*) depict various detail views of a tray embodiment 202. In some embodiments, a tray 202 can have a front side 702 and a rear side 704 that can be substantially orthogonal to a base 706. In some embodiments, a front side 702 can have a taller height than a rear side 704 to create a substantially trapezoidal lateral cross-section. However, in other embodiments, a front side 702 and a rear side 706 can be of substantially equal heights to produce a substantially rectangular lateral cross-section, or any other known and/or convenient geometry. In some embodiments a tray 202 can have a substantially rectangular base 706 and dimensions to hold various garnishes, but in other embodiments can have any other known and/or convenient dimensions. In some embodiments a tray 202 can have a substantially rectangular base 706 with rounded edges 708, but in other embodiments can have any other known and/or convenient dimensions FIGS. 8(*a*)-8(*d*) show various views of a handle 112. In some embodiments, a handle 112 can have a grip-enhancing surface 802 on the central portion. In some embodiments, a grip-enhancing surface 802 can be comprised of ridges, texturing, but in other embodiments can be any other known and/or convenient device.

FIGS. 9(*a*)-9(*d*) show various views of a latch 110. In some embodiments a latch 110 can have a rounded front edge 902, but in other embodiments can have any other known and/or convenient configuration. As shown in FIGS. 9(*b*) and 9(*d*), a latch 110 can have a protrusion 904 from the bottom surface.

Figure 10A:
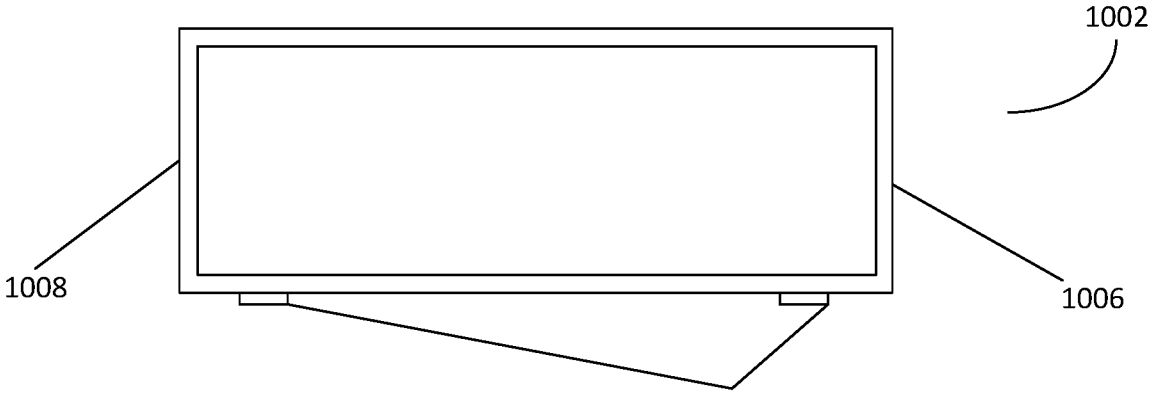
FIG. 10*a* depicts a planar interior view of an embodiment of an additional container in the present device.
Figure 10B:
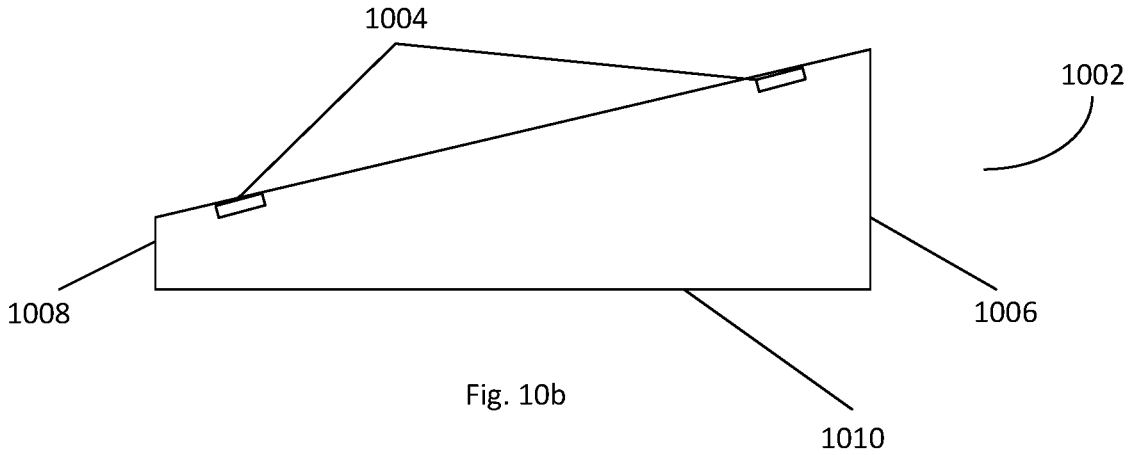
FIG. 10*b* depicts a perspective view of an embodiment of an additional container in the present device.
Figure 10C:
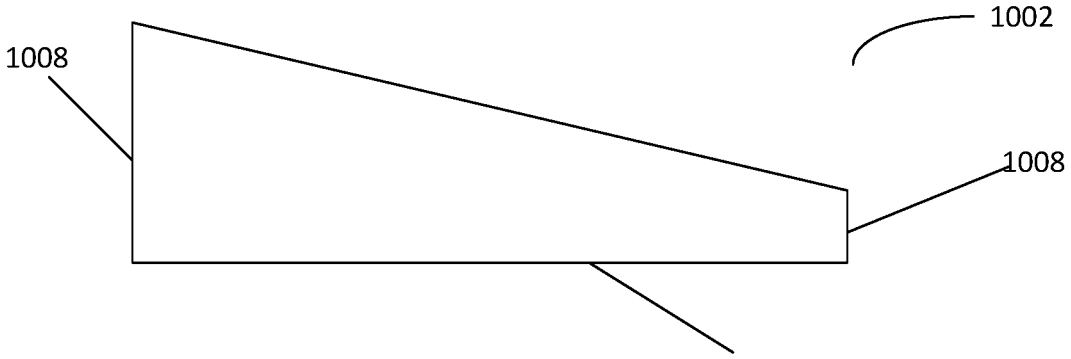
FIG. 10*c* depicts a cross-sectional view of an embodiment of an additional container in the present device.

FIG. 10(*a*)-10(*c*) show various views of an embodiment of a supplementary container for the present device. In some embodiments, a supplementary container 1002 can have a lateral profile substantially the same as the cross-section of a second section 106. As shown in FIGS. 10(*a*) and 10(*b*), a supplementary container 1002 can have connecting devices 1004 that can removably connect with a side of a second section 106. A connecting device 1004 can be a clip, removable adhesive, or any other known and/or convenient device. In some embodiments a front side 1006 can be of a shorter height than a rear side 1008 of a supplementary container 1002 to substantially match the profile of a second section 106, which, in some embodiments can be considered a "lower" section of a container 102, but in other embodiments can be any other known and/or convenient configuration.

In use, in some embodiments, a person can fill tray 202 with toothpicks, tray 206 with napkins, and trays 210 with garnishes. However, in other embodiments trays 202 206 210 can be filled with any other known and/or convenient items. Trays 202 206 210 can be placed into a lower section 106 of a container and can be held in place by a divider 216. A container 102 can be put into a closed configuration and held secure by latches 110.

When a destination is reached, a container 102 can be opened such that a first section 104 can lie substantially flat adjacent to a second section 106 on the same surface, as shown in FIG. 2. The inner surface of the planar surface of a first section 104 can be utilized as a preparation area with the garnishes, napkins, and toothpicks readily accessible.

When finished, a user can flip a first section 104 back to a closed configuration and secure a first section 104 and a second section 106 with latches 110. A container 102 can then be returned, emptied, and cleaned for the next use.

Although exemplary embodiments of the invention have been described in detail and in language specific to structural features and/or methodological acts above, it is to be understood that those skilled in the art will readily appreciate that many additional modifications are possible in the exemplary embodiments without materially departing from the novel teachings and advantages of the invention. Moreover, it is to be understood that the subject matter defined in the appended claims is not necessarily limited to the specific features or acts described above. Accordingly, these and all such modifications are intended to be included within the scope of this invention construed in breadth and scope in accordance with the appended claims.

What is claimed is:

1. A portable container for transporting bar garnishes and equipment, comprising:

a first section comprising a base and two sets of substantially parallel sides to form a first cavity and a second section comprising a base and two sets of substantially parallel sides sides to form a second cavity, wherein said first section and said second section have substantially trapezoidal cross-sections where the lateral parallel sides are of differing heights, wherein the taller height of the first section can be substantially the same as the shorter height of the second section;

wherein said first section and said second section are removably connected along one lateral edge with hinges and along an opposite lateral edge with latches;

a handle;

a divider running lengthwise in said second section, wherein the divider includes at least one notch;

a plurality of removable and interchangeable trays that selectively engage with said second section, wherein said trays each have a substantially rectangular base with rounded edges and wherein at least one of said trays includes a cutout in a first side.

2. The portable container of claim 1, wherein at least one of said trays is divided into sections.

3. The portable container of claim 2, wherein at least one of said trays has a substantially square base.

4. The portable container of claim 1, further comprising at least one supplementary container wherein the longitudinal profile of said supplementary container is substantially congruent to the cross-section of a second section.

5. The portable container of claim 4, wherein said longitudinal profile and cross section are substantially trapezoidal.

6. The portable container of claim 5, further comprising a connecting device.

* * * * *